United States Patent [19]

Cunningham

[11] Patent Number: 5,029,853

[45] Date of Patent: Jul. 9, 1991

[54] TENNIS SERVE TRAINING NET DEVICE

[76] Inventor: Gregory A. Cunningham, 201 Main St., Edmonds, Wash. 98020

[21] Appl. No.: 466,965

[22] Filed: Jan. 18, 1990

[51] Int. Cl.[5] ..... A63B 61/00

[52] U.S. Cl. ..... 273/29 A

[58] Field of Search ..... 273/29 A, 26 A, 26 R, 273/407, 410, 400, 55 D, 181 F, 29 BB, 402, 411, DIG. 30, 29 R, 29 BB

[56] References Cited

U.S. PATENT DOCUMENTS

| | | | |
|---|---|---|---|
| 3,427,026 | 2/1969 | Mahoney | 273/26 A |
| 3,940,132 | 2/1976 | Lopatto | 273/29 A |
| 4,023,798 | 5/1977 | Pronin | 273/29 A |
| 4,295,648 | 10/1981 | Stromback | 273/26 A |
| 4,473,228 | 9/1984 | Klaus | 273/26 A |
| 4,502,685 | 3/1985 | Phillips | 273/29 A |
| 4,629,188 | 12/1986 | Mahieu | 273/26 A |
| 4,718,668 | 1/1988 | Sehipske | 273/26 A |
| 4,836,542 | 6/1989 | Crawley | 273/181 F |
| 4,842,284 | 6/1989 | Rushing et al. | 273/26 A |

*Primary Examiner*—Theatrice Brown

[57] ABSTRACT

An adjustable serve training net device (10) for developing a proper ball toss and contact point height for the serve. The practice net device (10) includes a lower ground base (15) having two base sides (11A) and (11B) and a cross base memer (21). A pair of support legs (**22*a*) and (22*b*) attach to lower ground base (15) and support the upper net structure (41) above the ground base (15). Telescoping members (24*e*) and (24*b*) telescope in and out of support legs (22*a*) and (22*b*) enabling upper net structure (41**) to be raised or lowered to the desired height needed by the individual.

5 Claims, 4 Drawing Sheets

EXPLODED VIEW

ASSEMBLED VIEW

OPERATIONAL VIEW

PERSPECTIVE VIEW

TENNIS SERVE TRAINING NET DEVICE

BACKGROUND

1. Field of Invention

This invention relates to tennis serve training devices, specifically to such devices which try and help develop a ball toss and contact hitting point for the serve.

2. Description of Prior Art

Devices have been developed to provide overhead assistance for learning a ball toss but offer little assistance for developing a proper contact point height for serving the ball. These other devices are insufficient because they do not significantly help an individual learn both these aspects of the serve.

Examples of these devices are disclosed in the following issued U.S. Patents: U.S. Pat. No. 4,502,685 issued Mar. 5, 1985, to Vanice and Glendale Phillips; U.S. Pat. No. 4,023,798 issued May 17, 1977, to Alexander Pronin; and U.S. Pat. No. 3,940,132 issued Feb. 24, 1976, to John S. Lopatto.

In the patent issued to Vanice and Glendale Phillips, the device uses a suspended overhead target. The problem with this device is that the target interferes with the individuals swing. The individual must raise the target above their proper contact point height when serving the ball. The device therefore does not help individuals develop a proper ball toss or contact point height for the serve.

In the patent issued to Alexander Pronin, the device uses a complex and bulky overhead target which is aligned with a ground target below. This device is complicated to use and would be inconvenient to set-up and move around because of its size and weight.

In the patent issued to John S. Lopatto, the device suspends tennis balls overhead by the use of an electrically-operated suction pump. This device is very complex and presents an inconvenience because most outdoor public tennis courts do not have electricity available.

The need therefore exists for a tennis serve training net device operated on the tennis court just out in front of the individuals serve follow through. With the device properly placed out in front of the individual there is no interference unlike the overhead devices mentioned above.

OBJECT AND ADVANTAGES

The object of the tennis serve training net device is to help individuals develop a proper ball toss and contact point height for their serve.

The first advantage of the present invention is that the device permits the individuals serve to be carried out without any overhead interference.

The second advantage of the present invention is that the top portion of the upper net structure helps out as a reference point for the individual. The reference point helps the individual determine the proper height needed for the ball toss and the height at which the tennis ball must exceed when serving the ball.

The third advantage of the present invention is that the device is adjustable in height. The device is adjustable in height so it can be used effectively by individuals with various serving heights.

Some additional advantages of the present invention are that it is easy to transport, quick to set-up, simple to use and durable enough to withstand any hazards it may encounter.

These and additional advantages of the present invention will become apparent after a consideration of the drawings and the ensuing descriptions thereof.

DRAWING FIGURES

In the drawings, closely related figures have the same number but different alphabetic suffixes.

REFERENCE NUMBERS AND NUMBERS WITH ALPHABETIC SUFFIXES IN DRAWINGS

Figure 1A:
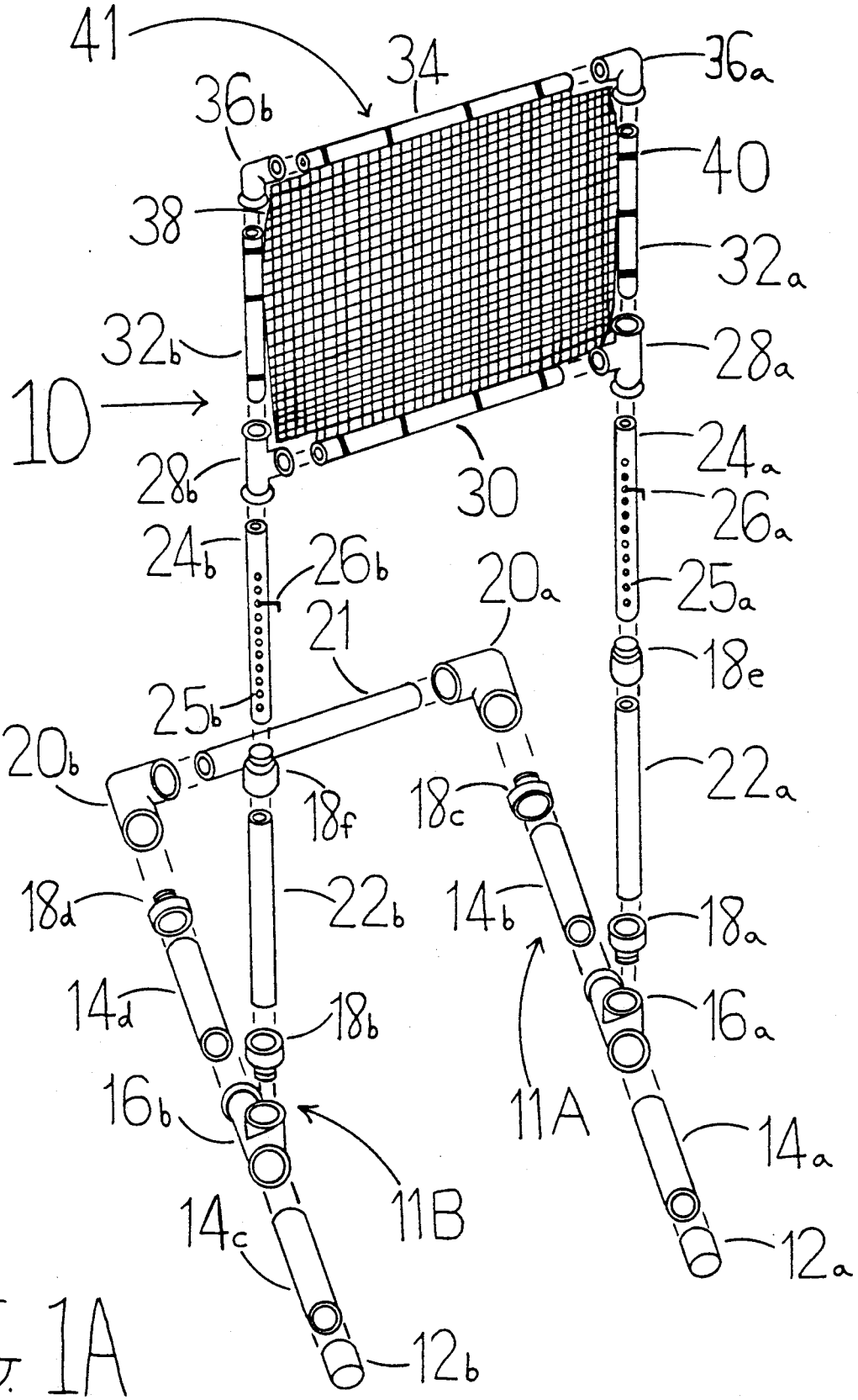
FIG. 1A shows an exploded view of the present invention.

10 complete embodiment of present invention
11 A, B base sides of lower ground base structure 15
12 a, b end caps
14 a, b, c, d tubular side base members
15 complete lower ground base structure
16 a, b female-thread tee fittings
18 a, b, c, d, e, f male-thread adaptors
20 a, b female-thread ell fittings
21 tubular cross base member
22 a, b tubular support legs
24 a, b tubular telescoping members
25 a, b adjustment holes
26 a, b adjustment pins
28 a, b slip tee fittings
30 lower tubular net support
32 a, b tubular side net supports
34 upper tubular net support
36 a, b slip elbow fittings
40 velcro straps
41 complete upper net structure

DESCRIPTIONS

Figure 1B:
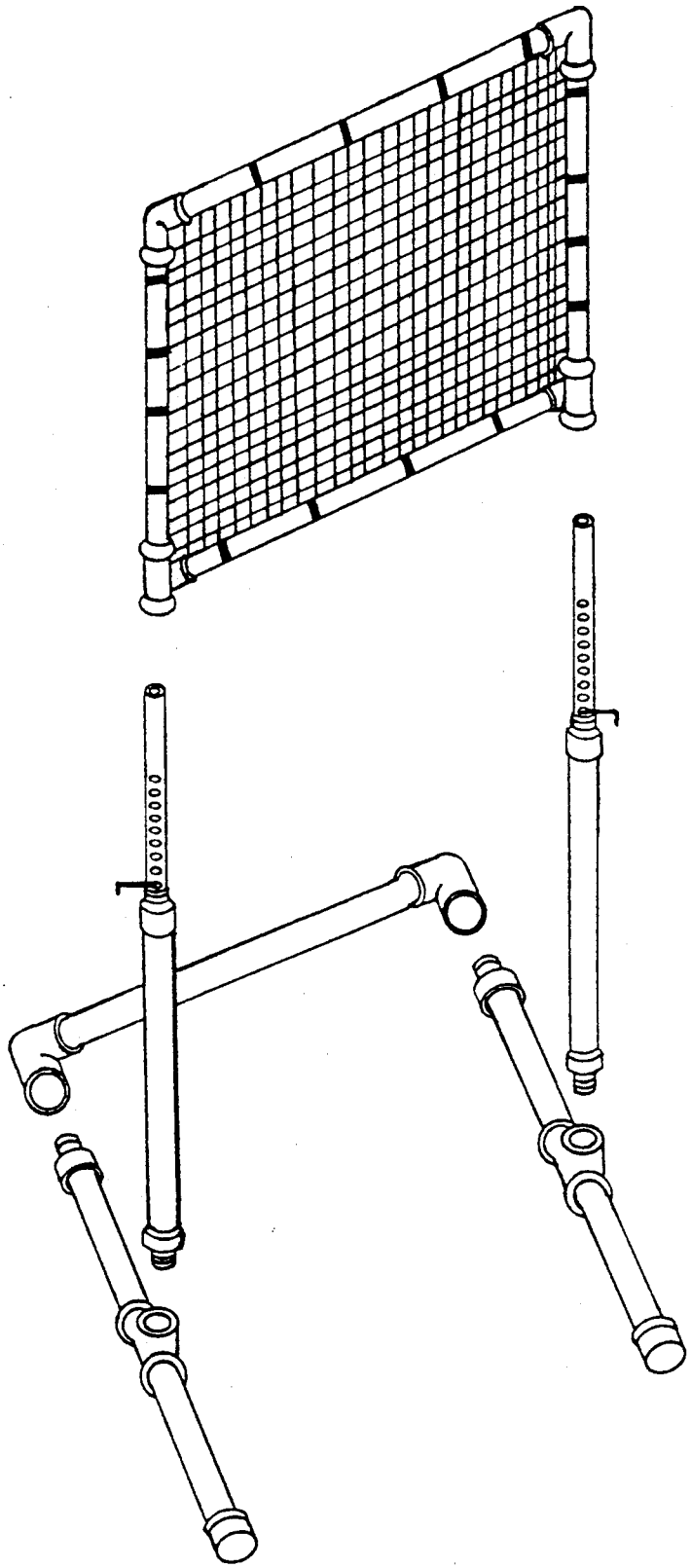
FIG. 1B shows the assembled parts in each section.

FIGS. 1A and 1B

The complete embodiment of the present inventions serve training structure is illustrated in FIG. 1A (exploded view) and FIG. 1B (assembled view). The structure of the tennis serve training net device has a lower ground base 15 (FIG. 1B), two support legs **22*a* and 22*b*, telescoping members 24*a* and 24*b* and a upper net structure 41**. In the preferred embodiment, the tennis serve training devices structure consists of durable plastic tubular piping and platic pipe fittings—available from Industrial plastics Inc.

The lower ground base structure 15 as illustrated in (FIG. 1B) has two vertically parallel base sides 11A and 11B and a tubular horizontal cross base member 21.

Base side 11A (FIG. 1A) has an end cap **12*a* slipped over top and attached in place with an adhesive to the front end of tubular side base member 14*a*. The opposite end of tubular side base member 14*a* slides into the front slip opening of female-thread tee fitting 16*a* and is attached in place with an adhesive. Tubular side base member 14*b* slides its front end into the rear slip opening of female-thread tee fitting 16*a* and is attached in place with an adhesive. The opposite end of tubular side base member 14*b* slides into the front slip opening of male-thread adaptor 18*c* and is attached in place with an adhesive to complete base side 11A**.

Base side 11B (FIG. 1A) has an end cap **12*b* slipped over top and attached in place with an adhesive to the front end of tubular side base member 14*c*. The opposite end of tubular side base member 14*c* slides into the front slip opening of female-thread tee fitting 16*b* and is attached in place with an adhesive. Tubular side base member 14*d* slides its front end into the rear slip opening of female-thread tee fitting 16*b* and is attached in place with an adhesive. The opposite end of tubular side base member 14*d* slides into the front slip opening of male-thread adaptor 18*d* Description-FIGS. 1A and 1B continued and is attached in place with an adhesive to complete base side 11B**.

Tubular cross base member 21 (FIG. 1A) is positioned horizontally across the top ends of the two vertically parallel basesides 11A and 11B. The two female ell fittings **20*a* and 20*b* slide their slip openings over top each end of tubular cross base member 21 and are attached in place with an adhesive to complete cross base member 21**.

Base side 11A (FIG. 1B) attaches inside the female ell fitting **20*a* located on the right end of tubular cross base member 21. The connection is made by twisting base side 11A's rear male-thread adaptor 18*c* into the front thread opening of female ell fitting 20*a***.

Base side 11B (FIG. 1B) attaches inside the female ell fitting **20*b* located on the left end of tubular cross base member 21. The connection is made by twisting base side 11B's rear male-thread adaptor 18*d* into the front thread opening of female ell fitting 20*b* to complete the lower ground base structure 15**.

The tubular support legs **22*a* and 22*b* of the present invention and their telescoping members 24*a* and 24*b* are illustrated in FIGS. 1A and 1B**.

Tubular support leg **22*a* (FIG. 1A) slides its lower end into the top slip opening of lower male-thread adaptor 18*a* and is attached in place with an adhesive. The upper male-thread adaptor 18*e* slides its lower slip opening over top the upper end of tubular support leg 22*a*** and is attached in place with an adhesive.

The tubular support leg **22*a* (FIG. 1B) connects with female tee fitting 16*a* located on base side 11A of the lower ground base structure 15. The connection is made by twisting support leg 22*a*'s lower male-thread adaptor 18*a* inside the top thread opening of female-thread tee fitting 16*a***.

Support leg **22*a* has tubular telescoping member 24*a* (FIG. 1B) sliding into the top opening of male thread adaptor 18*e*. The telescoping member 24*a* extends down into the tubular support leg 22*a*. The telescoping member is secured in place by steel height adjustment pin 26*a* sliding through one of the height adjustment holes 25*a* of the telescoping member 24*a***.

Tubular support leg **22*b* (FIG. 1A) slides its lower end into the top slip opening of lower male-thread adaptor 18*b* and is attached in place with an adhesive. The upper male-thread adaptor 18*f* slides its lower slip opening over top the upper end of tubular support leg 22*b*** and is attached in place with an adhesive.

The tubular support leg **22*b* (FIG. 1B) connects with female tee fitting 16*b* located on base side 11B of the lower ground base structure 15. The connection is made by twisting support leg 22*b*'s lower male-thread adaptor 18*b* inside the top thread opening of female-thread tee fitting 16*b***.

Support leg **22*b* has tubular telescoping member 24*b* (FIG. 1B) sliding into the top opening of male thread adaptor 18*f*. The telescoping member 24*b* extends down into the tubular support leg 22*b*. The telescoping member is secured in place by steel height adjustment pin 26*b* sliding through one of the height adjustment holes 25*b* of the telescoping member 24*b***.

DESCRIPTION

FIGS. 1A and 1B continued

The upper net structure 41 of the present invention is illustrated in FIGS. 1A and 1B. The upper net structure 41 (FIG. 1A) has tubular side net supports **32*a* and 32*b* plus upper tubular net support 34 and lower tubular net support 30**.

Tubular side net support **32*a* (FIG. 1A) extends vertically and slides its lower end into the top slip opening of slip tee fitting 28*a* and is attached in place with an adhesive. The slip elbow fitting 36*a* slides its lower slip opening over top the upper end of tubular side net support 32*a*** and is attached in place with an adhesive.

Lower tubular net support 30 (FIG. 1A) extends horizontally and slides its right end onto the side slip opening of slip tee fitting **28*a* and attached in place with an adhesive. The opposite end of lower tubular net support 30 slides into the side slip opening of slip tee fitting 28*b*** and is attached in place with an adhesive.

Side net support **32*b* (FIG. 1A) extends vertically and slides its lower end into the top slip opening of slip tee fitting 28*b* and is attached in place with an adhesive. The slip elbow fitting 36*b* slides its lower slip opening over top the upper end of tubular side net support 32*b*** and is attached in place with an adhesive.

The upper tubular net support 34 (FIG. 1A) extends horizontally and slides its left end into the remaining side slip opening of slip elbow fitting **36*b* and is attached in place with an adhesive. The opposite end of upper tubular net support 34 slides into the remaining side slip opening of slip elbow fitting 36*a* and is attached in place with an adhesive to complete the upper net structure 41**.

The netting 38 (FIG. 1A) attaches to the upper net structure 41 by wrapping velcro strips 40 through the netting and then attaching them around the frame members of the upper net structure 41.

The upper net structure 41 (FIG. 1B) is secured in place on the upper ends of tubular telescoping members **24*a* and 24*b*. The connection is made by sliding the lower slip openings of slip tee fittings 28*a* and 28*b* of the upper net structure over top the upper ends of telescoping members 24*a* and 24*b***.

From the description FIGS. 1A and 1B, a few other advantages of my tennis serve training net device become evident.

The use of the thread pipe fittings in the present invention make the device quick and easy to set-up.

The use of velcro strips 40 allow the netting 38 to be attached quickly and easily to the frame members of the upper net structure 41.

The design of the present inventions lower ground base structure 15 almost makes it impossible for the device to accidently tip over.

OPERATIONAL

Figure 2:
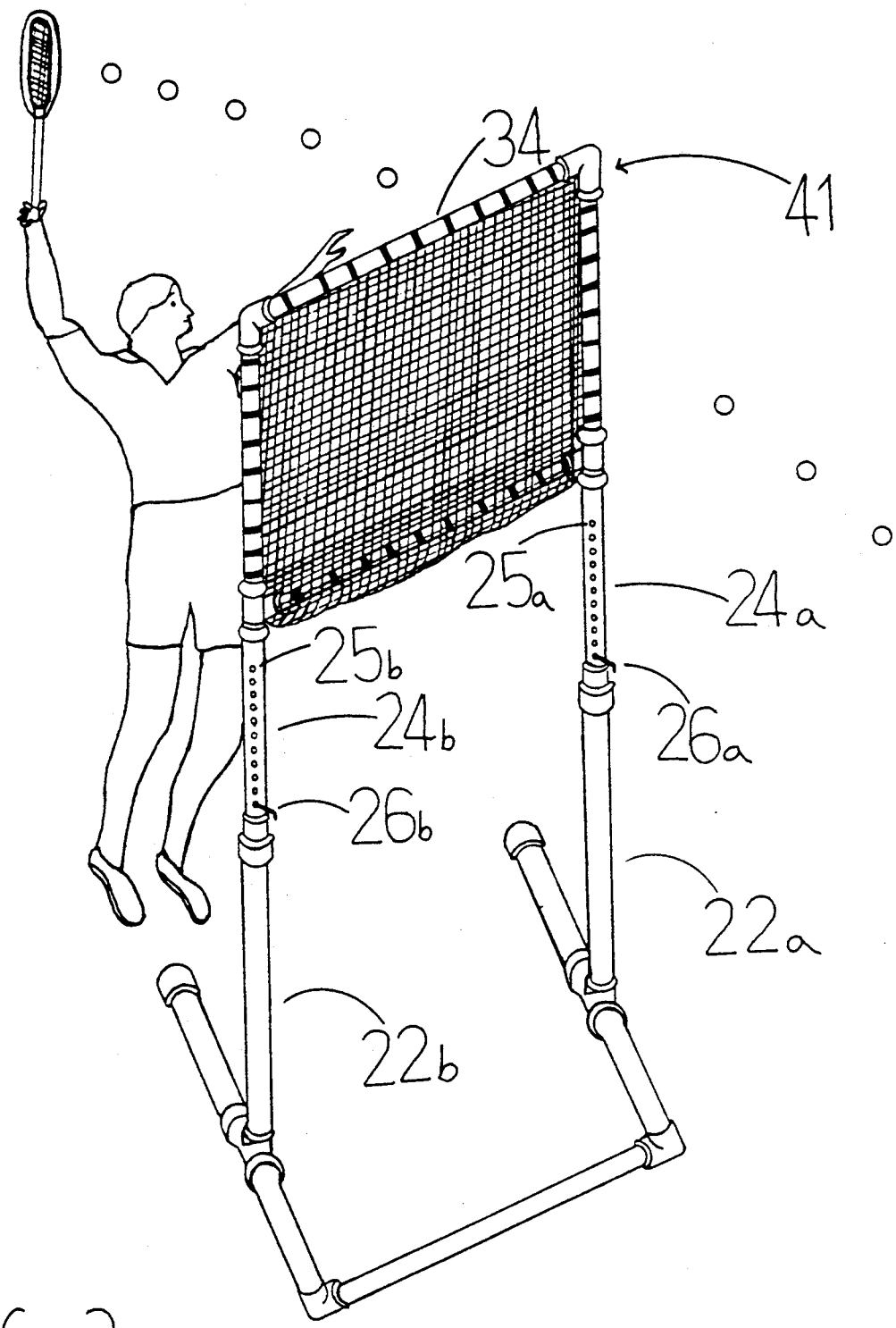
FIG. 2 shows general function of present invention.
Figure 3:
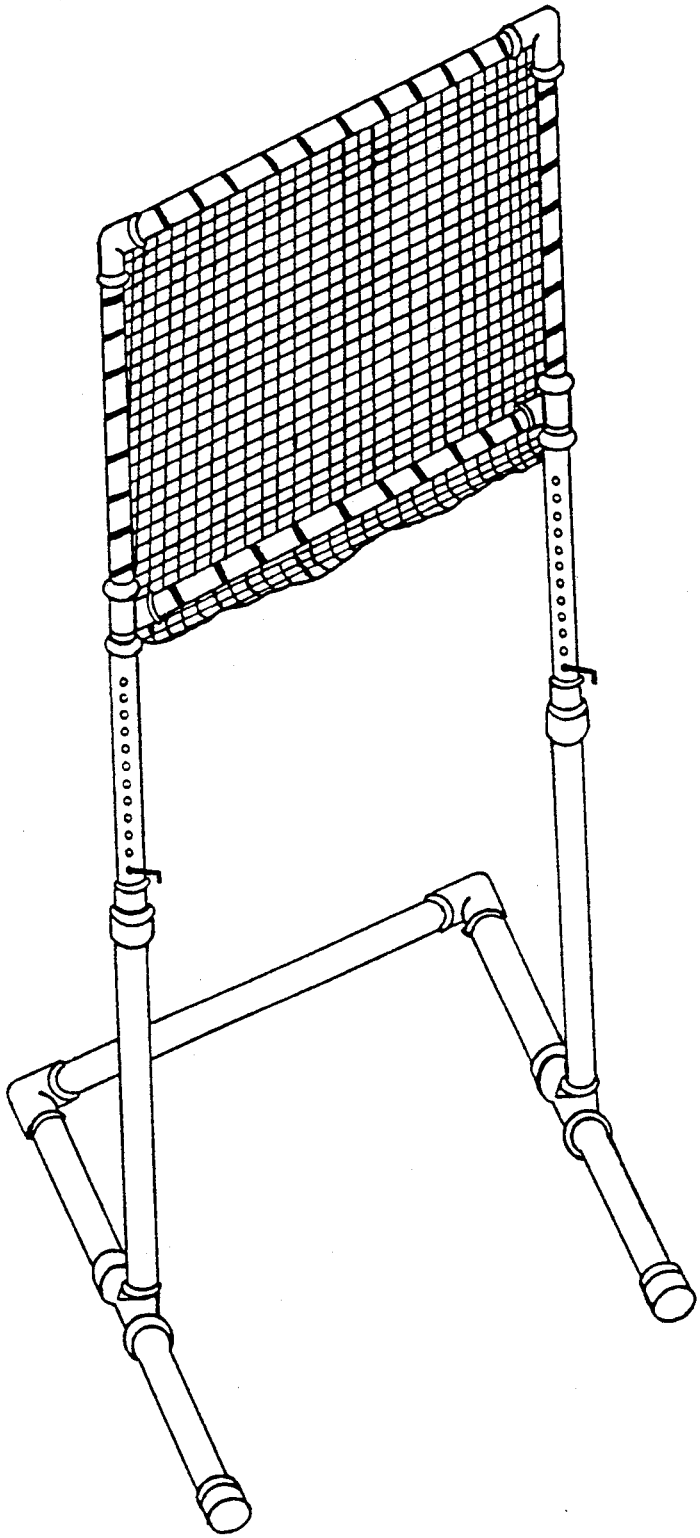
FIG. 3 shows a perspective view of the present invention.

FIGS. 1B and 2

The manner of using the present tennis serve training net device 10 is quite different from other known tennis serve training devices. The present device as shown in (FIG. 2) is designed to be set-up and operated out in front of the individual rather than directly overhead.

The first step is to set-up the present serve training net device 10 (FIG. 1B). The individual starts by assembling the lower ground base structure 15. The lower ground base structure 15 (FIG. 1B) is equipped with tubular cross base member 21 which has two female-thread ell fittings 20*a* and 20*b* on its ends. The lower ground base is also equipped with two base sides 11A and 11B that have male-thread adaptors 18*c* and 18*d* on each rear end. The male-thread adaptors allow the two base sides to attach to cross base member 21 to complete the lower ground base structure 15.

The support legs 22*a* and 22*b* of the present invention (FIG. 1B) are attached next. The support legs are designed to attach easily to the lower ground base structure 15. The support leg 22*a* attaches to base side 11A by twisting its lower male-thread adaptor 18*a* into the top thread opening of female-thread ell fitting 16*a*. The support leg 22*b* attaches to base side 11B by twisting its lower male-thread adaptor 18*b* into the top thread opening of female-thread ell fitting 16*b*. The support legs 22*a* and 22*b* (FIG. 2) along with their telescoping members 24*a* and 24*b* support the upper net structure 41 up and out in front of the individual.

The height adjustment of each telescoping member 24*a* and 24*b* (FIG. 2) is made by sliding each telescoping member up or down to the next same desired height adjustment holes 25*a* or 25*b*. The height desired is secured by placing each height adjustment pin 26*a* and 26*b* through one of the height adjustment holes 25*a* and 25*b*. Operational-FIGS. 1B and 2 continued The upper net structure 41 (FIG. 2) which is supported up and out in front of the individual by the telescoping members 24*a* and 24*b* is designed to stop improper hit tennis balls. The upper net support 34 (FIG. 2) of the upper net structure 41 acts as a reference point for the individual. The reference point helps the individual determine the height needed for their ball toss and the height the tennis ball must exceed when they contact the ball.

The purpose of the present invention is to help people develop a proper ball toss and contact hitting point for the serve.

The individual starts by positioning one's self along the service base line in their normal serving position. The serve training net device 10 is placed about six inches out in front of their serve follow through.

The individual begins with the serve training net device 10 at its lowest level. The individual must execute a proper ball toss and contact the tennis ball successfully above the upper net support 34 and have the tennis ball land successfully in the service box. If they achieve this they can move the upper net structure 41 up to the next height adjustment level.

The individual as they gradually move up each height adjustment level will begin to develop a fundamentally sound ball toss and contact hitting point height for the serve. The individual will achieve their proper serving height when they reach the highest level above the upper net support 34 (FIG. 2) in which they can execute a successful serve in the service box.

The individual who experiences difficulties getting the proper height on the ball toss and contacts the tennis ball to low will simply hit the tennis ball into the upper net structure 41. The individual must remain at their present level or drop down a level until they achieve a successful serve above the upper net support 34 which lands in the service box.

SUMMARY, RAMIFICATION AND SCOPE

The reader will see that the structure of the present serve training net device which is set-up out in front of the individual consists of plastic tubular piping and various plastic fittings. The plastic fittings allow the device to be set-up and taken down quickly. In addition plastic tubular telescoping members are used so the tennis serve training net device can be adjusted in height to suit the height needed by any individual using it.

Although the description above contains some specific descriptions this should not be construed that the present invention is limited to these descriptions given. Its possible that various other materials could be used to construct the structure of the tennis serve training device. For example, the present invention could utilize a light weight metal tubular piping or even a aluminum piping and pipe fittings for its structure.

Thus the scope of the invention should be determined by the appended claims and their legal equivalents, rather than by the examples given.

What I claim is:

1. A tennis serve training apparatus to help a player determine the proper ball toss height during tennis ball serve, comprising;

(a) a substantially U-shaped ground support base structure, (b) a pair of tubular, vertically extending, spaced apart leg members, said leg members being substantially equal in length; each of said leg members having its lower end attached to a leg of said U-shaped base structure.

(c) a substantially rectangular, vertically extending frame structure, (d) net means having its peripheral edges attached within and to said frame structure to form a substantially planar barrier area, (e) a pair of vertically extending telescoping members, each said telescoping member having its upper end rigidly attached to said frame structure and its lower end telescopingly and adjustably extending into a respective said leg member, each of said telescoping members having a plurality of vertically aligned, horizontally extending apertures extending therethrough, (f) pin means for insertion into said apertures for holding said frame structure at predetermined adjusted heights relative to said base structure, (g) attachment means at each end of each of said leg members for detachably securing either end thereof to said U-shaped base structure and for telescopingly receiving a said telescoping member.

2. A tennis serve training apparatus as defined in claim 1 wherein; each said U-shaped base member and said rectangular frame member is comprised of a plurality of tubular members connected by elbow and T-fittings.

3. A tennis serve training apparatus as defined in claim 2 wherein, said attachment means are threaded fittings threadably received in a said T-fitting.

4. A tennis training apparatus as defined in claim 3 wherein, said net means is attached to said rectangular from structure by hook and loop fastener means.

5. A tennis serve training apparatus as defined in claim 4 wherein, an end cap is secured at the free end of each leg of said U-shaped base structure.

* * * * *